US008950620B1

(12) United States Patent
McDuffie

(10) Patent No.: US 8,950,620 B1
(45) Date of Patent: Feb. 10, 2015

(54) METHOD AND APPARATUS FOR DIVIDING A GARBAGE CAN INTO A PLURALITY OF SUBSECTIONS OF GARBAGE BAG LINED CONTAINMENT ZONES WHICH HAVE AN ADJUSTABLE VOLUME CHARACTERISTIC

(71) Applicant: Warren C McDuffie, Iowa City, IA (US)

(72) Inventor: Warren C McDuffie, Iowa City, IA (US)

( * ) Notice: Subject to any disclaimer, the term of this patent is extended or adjusted under 35 U.S.C. 154(b) by 84 days.

(21) Appl. No.: 13/738,141

(22) Filed: Jan. 10, 2013

Related U.S. Application Data

(60) Provisional application No. 61/586,055, filed on Jan. 12, 2012.

(51) Int. Cl.
*B65D 25/14* (2006.01)
*B65B 67/12* (2006.01)
*B65B 43/26* (2006.01)

(52) U.S. Cl.
CPC ..... *B65B 67/1205* (2013.01); *B65B 43/26* (2013.01); *Y10S 220/9081* (2013.01)
USPC ..... 220/495.09; 220/908.1; 220/495.01; 248/100

(58) Field of Classification Search
CPC ..... B65F 1/06; B65F 1/067; B65D 25/16
USPC ..... 248/99, 100, 101; 220/495.01, 495.08, 220/495.09, 495.1, 495.11, 551, 908.1
See application file for complete search history.

(56) References Cited

U.S. PATENT DOCUMENTS 3,561,077 A * 2/1971 Grant ..... 248/95
4,189,808 A * 2/1980 Brown ..... 24/30.5 R
4,535,911 A * 8/1985 Goulter ..... 220/495.1
4,576,310 A * 3/1986 Isgar et al. ..... 220/495.1
4,750,638 A * 6/1988 Sosower ..... 220/495.09
4,905,853 A * 3/1990 Strawder ..... 220/523
5,085,342 A * 2/1992 Strawder ..... 220/495.09
5,096,086 A * 3/1992 Crema ..... 220/533
5,127,538 A * 7/1992 Bach ..... 220/529
5,154,378 A * 10/1992 Plum ..... 248/99
5,183,228 A * 2/1993 Curry ..... 248/100
5,188,254 A * 2/1993 Evans ..... 220/495.09
5,190,183 A * 3/1993 McNaughton et al. ..... 220/551
5,190,252 A * 3/1993 Schrager ..... 248/97
5,193,713 A * 3/1993 Greathouse et al. ..... 220/528
5,238,139 A * 8/1993 Bisceglia ..... 220/495.09
5,320,241 A * 6/1994 Evans ..... 220/495.09
5,695,088 A * 12/1997 Kasbohm ..... 220/495.11
5,765,613 A * 6/1998 Schrager ..... 141/390
5,885,002 A * 3/1999 Reiss ..... 383/37
5,915,584 A * 6/1999 Sposit et al. ..... 220/495.09
6,286,706 B1 * 9/2001 Tucker ..... 220/495.11
6,378,721 B1 * 4/2002 Williams ..... 220/495.08
7,204,407 B2 * 4/2007 Laher ..... 232/1 B
7,290,674 B1 * 11/2007 Ledford ..... 220/507
7,694,838 B2 * 4/2010 Yang et al. ..... 220/495.11
2008/0197136 A1 * 8/2008 Dukes ..... 220/495.11
2008/0272127 A1 * 11/2008 Kovacevich et al. ..... 220/495.11
2010/0219192 A1 * 9/2010 Quan ..... 220/495.08
2013/0256314 A1 * 10/2013 Marconi ..... 220/495.09

* cited by examiner

*Primary Examiner* — Fenn Mathew
*Assistant Examiner* — Christopher McKinley
(74) *Attorney, Agent, or Firm* — Simmons Perrine Moyer Bergman PLC

(57) ABSTRACT

A garbage can liner system for use in a single compartment of a refuse container where the container volume is divided into subsections by placing and attaching a refuse receptacle divider system across the top of the container and by securing two garbage bags inside the container by attaching the bags to the divider system and to opposing ends of the container as is normally done. The divider system is adjustable so as to accommodate various sized containers so a single divider system can be used serially in several different garbage cans.

10 Claims, 8 Drawing Sheets

METHOD AND APPARATUS FOR DIVIDING A GARBAGE CAN INTO A PLURALITY OF SUBSECTIONS OF GARBAGE BAG LINED CONTAINMENT ZONES WHICH HAVE AN ADJUSTABLE VOLUME CHARACTERISTIC

BACKGROUND OF THE INVENTION

The present invention generally relates to recycling, and more particularly relates to a method and apparatus for facilitating recycling by dividing a single refuse container into subsections.

In the past, it is well known to have dedicated recycling bins for different types of recyclable materials, as well as having a single exterior container with multiple separate compartments therein.

Systems of separate containers, as well as single containers with multiple compartments, have enjoyed considerable success in the past. However, these systems have had several drawbacks.

When these systems of dedicated separate bins are used by a consumer, the result is often that each of the dedicated bins is smaller than a single bin that could hold all the material mixed together. Some consumers find a larger number of smaller refuse containers to be problematic in that they are easier to become accidentally dumped; for example by an accidental kick, etc. They may require multiple trips to the curb or other actions when the consumer is attempting to handle material from each of the containers. Single containers with multiple compartments are often fixed at predetermined and discrete configurations, and often, lining such compartments with garbage bags for easy cleanup is difficult.

Consequently, there exists a need for improved methods and apparatuses for providing more and smaller volume receptacles for refuse.

SUMMARY OF THE INVENTION

It is an object of the present invention to provide enhanced abilities to reduce inconvenience associated with recycling.

It is a feature of the present invention to include an apparatus for dividing a single refuse container into a system of multiple smaller containment zones.

It is an advantage of the present invention to reduce unwanted numbers of stand-alone refuse containers.

It is another object of the present invention to provide for increased ability to accommodate subdivision of refuse containers of various sizes.

It is another feature of the present invention to include an expanding beam member.

It is another advantage of the present invention to provide for an increased ability to reconfigure the size and number of smaller containment zones in a single stand-alone refuse container.

It is yet another object of the present invention to allow for use of garbage bags to retain garbage in predetermined containment zones within a single refuse container.

It is yet another feature of the present invention to include garbage bag receiving voids, as well as garbage bag engaging and refuse container lip emulating upwardly protruding fingers.

It is yet another advantage to allow for secure, but also easily adjustable attachment of multiple garbage bags, defining multiple separate variable volume and distinct containment zones within a single refuse container.

The present invention is an improved method and apparatus for dividing a stand-alone refuse container into multiple smaller containment zones, which improvement is designed to satisfy the aforementioned needs, provide the previously stated objects, include the above-listed features, and achieve the already articulated advantages. The present invention is carried out in a "clutter-less" system in the sense that a substantial reduction in number of standalone refuse containers needed by a typical consumer is achieved with the present invention.

Accordingly, the present invention is a method and apparatus . . . .

BRIEF DESCRIPTION OF THE DRAWINGS

The invention may be more fully understood by reading the following description of preferred embodiments of the invention, in conjunction with the appended drawings wherein.

DETAILED DESCRIPTION

Figure 1:
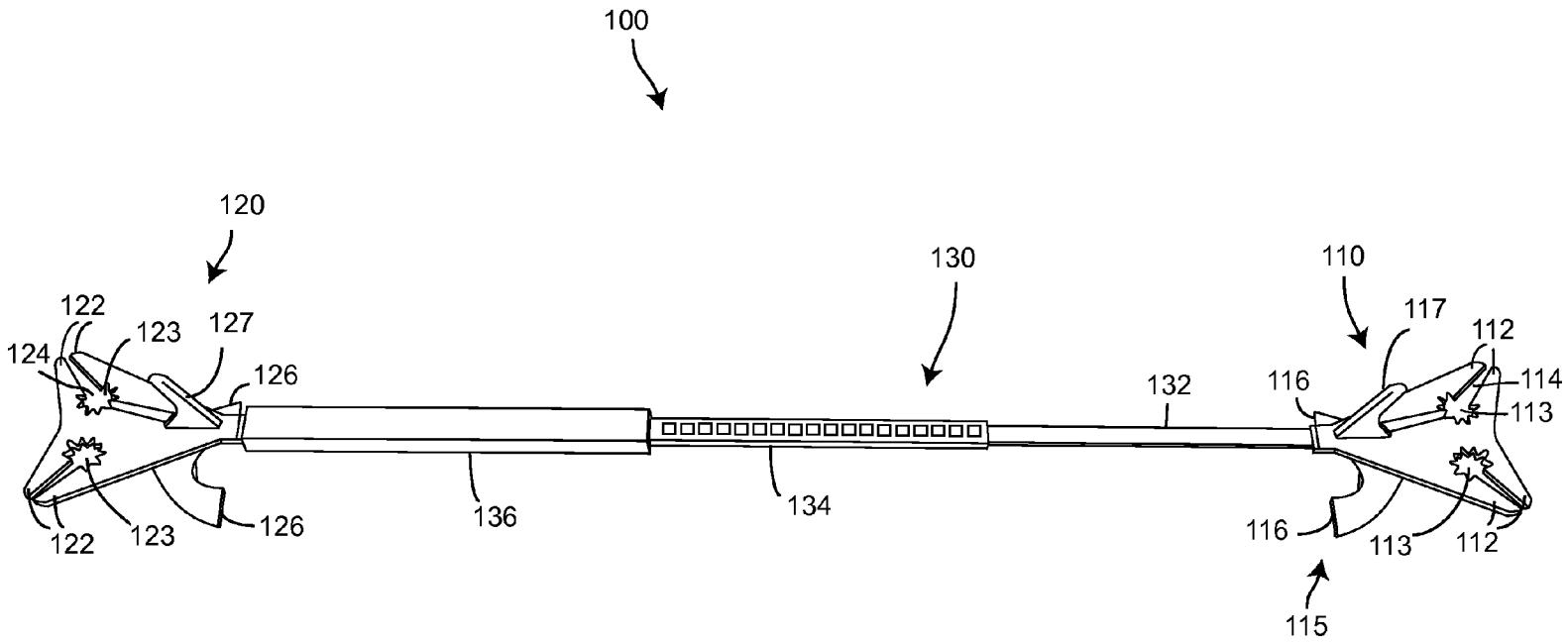
FIG. 1 is an overhead perspective view of the apparatus of the present invention.

Now referring to the drawings, wherein like numerals refer to like matter throughout, and more particularly to FIG. 1, there is shown a refuse receptacle divider system 100 which is generally used to provide for the ability to support multiple bags within a single refuse container, so as to effectively convert a single refuse container from being a support structure for a single bag to a support structure that is capable of supporting multiple bags, such as reused plastic grocery bags, garbage bags and/or other suitable bags.

Refuse receptacle divider system 100 is shown including a first gripping end 110 and a second gripping end 120 with disposed therebetween an adjustable length refuse container spanning beam 130.

First gripping end 110 may be attached to adjustable length refuse container spanning beam 130 and may include a first gripping end bag receiving insertion gap defining member 112, which may be a portion of a larger member which may be made with various materials, or it may be an individual component. First gripping end bag receiving insertion gap 114 is shown located between opposing first gripping end bag receiving insertion gap defining members 112. First gripping end bag gathering void 113 is located at the end of first gripping end bag receiving insertion gap 114 and is enlarged so as to allow for a larger portion of a garbage bag to be gathered therein. First gripping end bag receiving insertion gap defining member 112 would typically be located atop an upper peripheral lip of a refuse container and extending outwardly from said upper peripheral lip of a refuse container. First gripping end refuse container engaging foot 115 is configured to drop below the first gripping end bag receiving insertion gap defining member 112 and include first gripping end refuse container engaging foot prongs 116 which are configured to extend beneath a lower peripheral lip of the refuse container. The terminal end of each of the first gripping end refuse container engaging foot prongs 116 is configured to extend inwardly of the outermost edge of the peripheral lip of the refuse container. First gripping end 110 is also shown with a first gripping end bag engaging and refuse container lip emulating upwardly protruding finger 117 which is used to help define a limit of an extent of an opening of one of the multiple garbage bags. Second gripping end 120 may preferably be identical to first gripping end 110 and may include the following similar structures: second gripping end bag receiving insertion gap defining member 122, second gripping end bag gathering void 123, second gripping end bag receiving insertion gap 124, second gripping end refuse container engaging foot 125, second gripping end bag engaging and refuse container lip and second gripping end refuse container engaging foot prongs 126 and emulating upwardly protruding finger 127.

The refuse receptacle divider system 100 can be made with many different materials, such as plastic, metal, wood, recycled materials, composites, cardboard and other suitable materials and combinations thereof. The system may be made in many different ways. For example adjustable length refuse container spanning beam 130 is shown as having 3 pieces. If may be a single piece or more than 3 pieces depending upon the amount of adjustability in length is desired.

In any of these variations it is preferred to have the ability to grasp the first gripping end and adjust its separation from the second gripping end. Ideally, the adjustable length refuse container spanning beam 130 can be easily expanded (made longer) but may require some releasing action to allow the beam to be shortened. Various mechanisms such as detents, spring loaded or resilient buttons, ridges etc. could be used. The particular adjustment structure used will depend upon the particular application. For example, if the objects placed in the bags are heavy, then the adjustable length refuse container spanning beam 130 could resemble a tent pole with nested tubes, with one with a spring loaded button and the other with a series of holes. If the application is very light, then plastic couplers similar to zip-ties (either single use or releasable multi-use ties) could be used. Any suitable way of adjusting the length of the adjustable length refuse container spanning beam 130 is intended to be included within the scope of the present invention.

Figure 2:
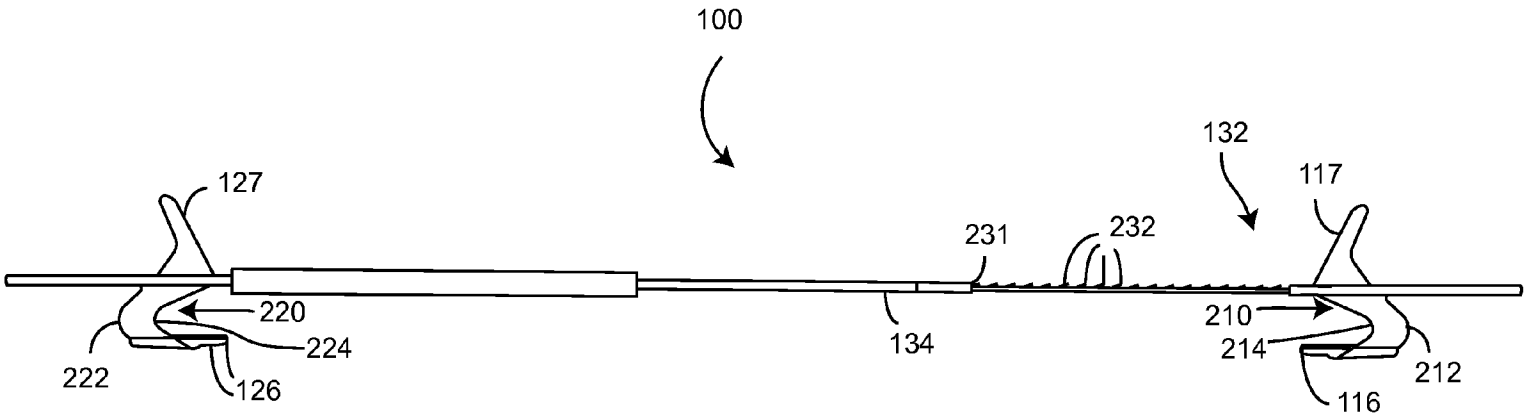
FIG. 2 is a side elevation view of the apparatus of FIG. 1.

Now referring to FIG. 2, there is shown a side view of the refuse receptacle divider system 100 of FIG. 1. First gripping end bag engaging and refuse container lip emulating upwardly protruding finger 117 and second gripping end bag engaging and refuse container lip emulating upwardly protruding finger 127 are more easily seen in FIG. 2. Also the fact that first gripping end refuse container engaging foot prongs 116 are lower than adjustable length refuse container spanning beam 130 is more easily seen. Additionally, riser 210 with outwardly pushing surface 212 and riser 220 with pushing surface 222, are shown. It should be understood that the adjustable length refuse container spanning beam 130 can be used to pull the first gripping end 110 and second gripping end 120 together on the outside of a refuse container as discussed above, or it can be used to push the first gripping end 110 and second gripping end 120 apart from inside the refuse container. The ridges 232 on innermost adjustable length refuse container spanning beam 132 may be used so that they are sized smaller than the opening 231 in middle adjustable length refuse container spanning beam 134 and designed to be sufficiently rigid to maintain a pushing or pulling force sufficient to hold the adjustable length refuse container spanning beam 130 in place with respect to a refuse container, but may be sufficiently resilient so as to allow the length of adjustable length refuse container spanning beam 130 to be adjusted by providing more force to pull or push past one of the ridges. Various length other adjusting mechanisms are contemplated. Also shown is outermost adjustable length refuse container spanning beam 136, and inwardly pushing surfaces 214, 224.

Figure 3:
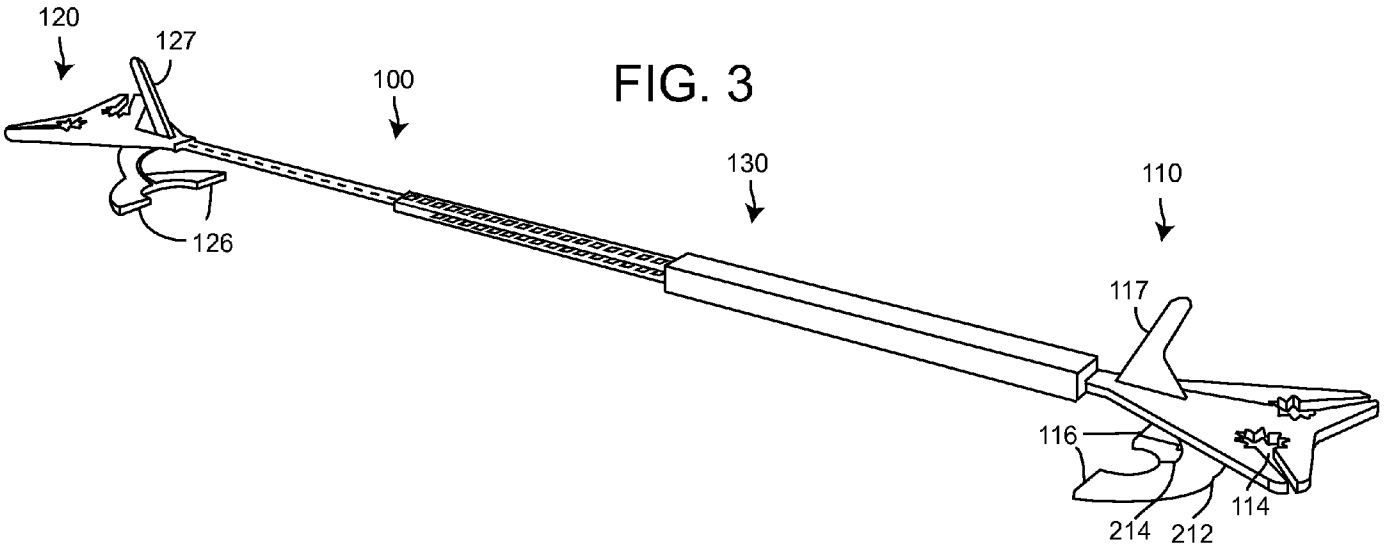
FIG. 3 is another perspective view of the apparatus of FIG. 1.
Figure 4:
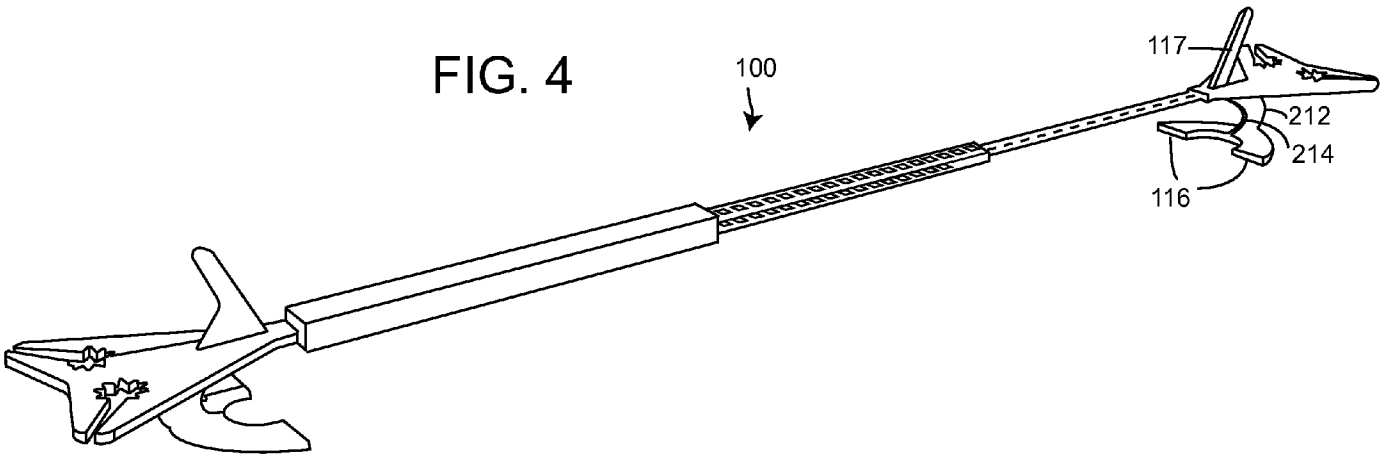
FIG. 4 is a perspective view of another system of the present invention.
Figure 5:
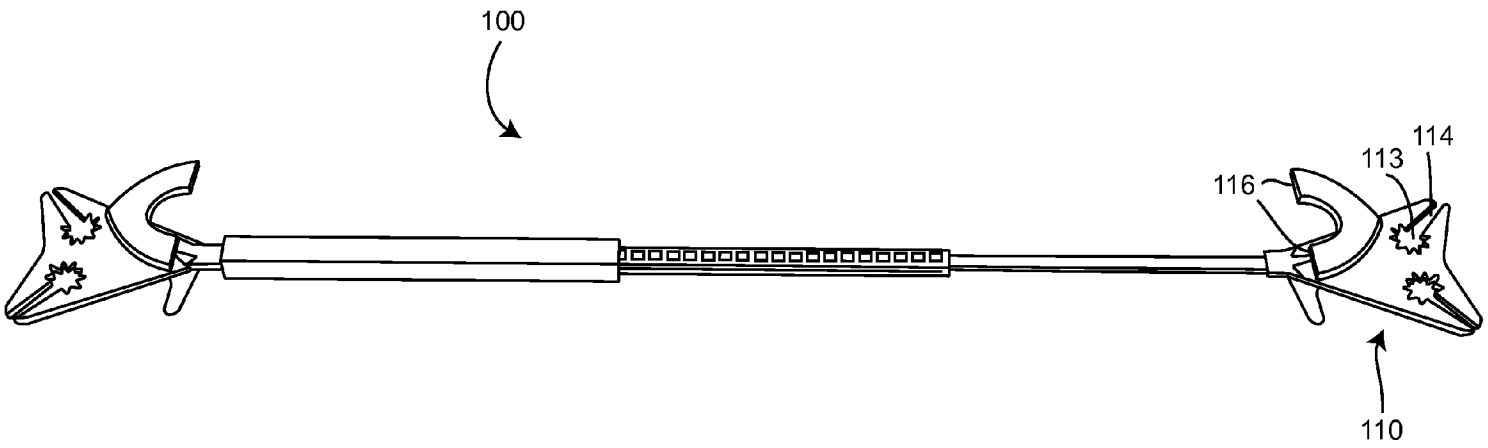
FIG. 5 is a perspective view of the underside of the apparatus of FIG. 1.

Now referring to FIGS. 3-5, there are shown various views of the refuse receptacle divider system 100 of the present invention and of FIGS. 1 and 2.

Figure 6:
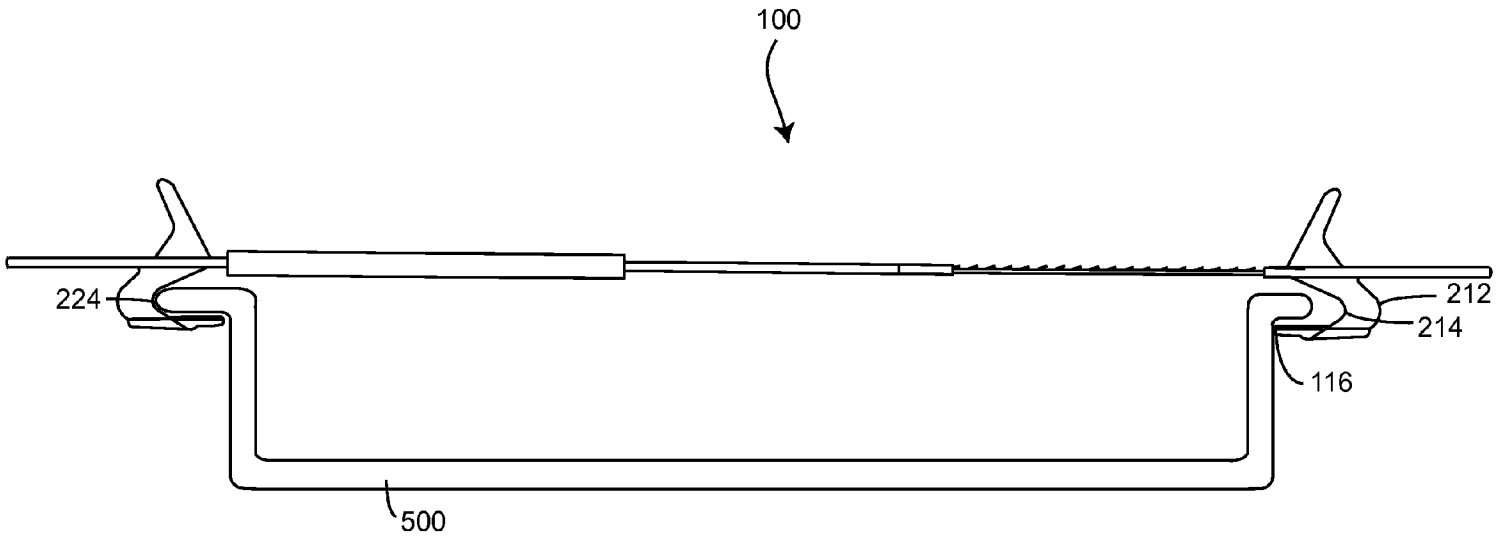
FIG. 6 is a view of the apparatus shown in FIG. 2 with a container being engaged from its outside.

Now referring to FIG. 6, there is shown a view of the refuse receptacle divider system 100 disposed across the top of a refuse container 500 and configured to apply an inward pressure on opposing external sides of the refuse container.

Figure 7:
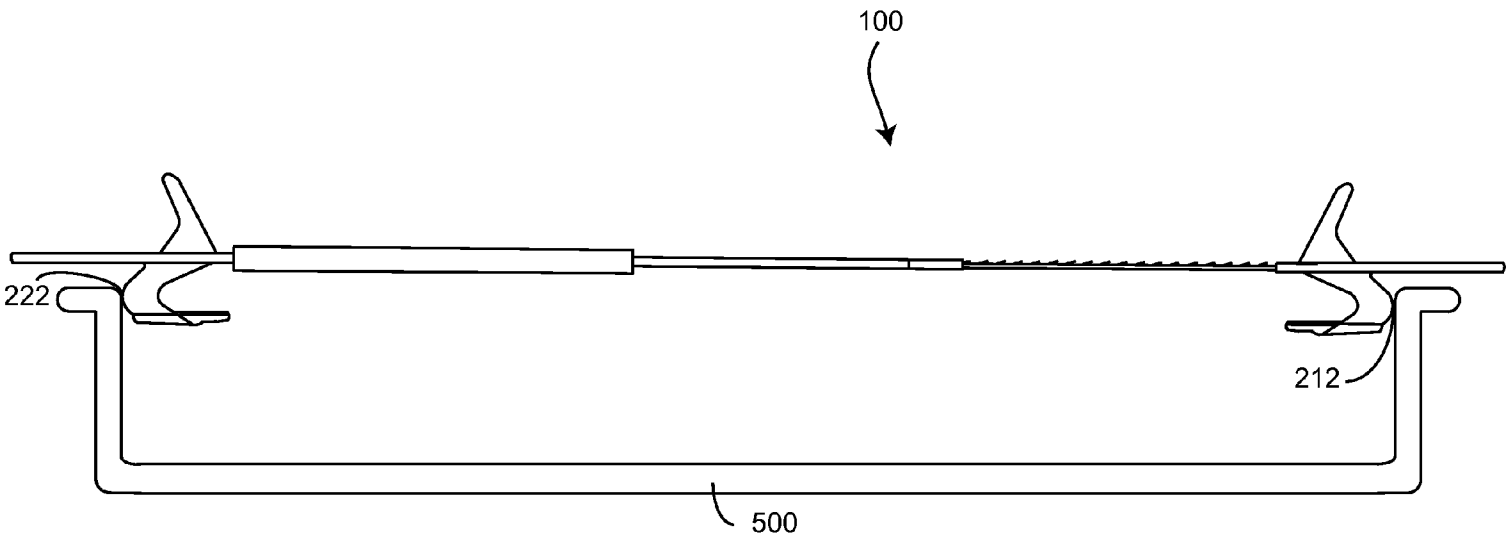
FIG. 7 is a view of the apparatus shown in FIG. 2 with a container being engaged from its inside.

Now referring to FIG. 7, there is shown a view of the refuse receptacle divider system 100 disposed across the top of a refuse container and configured to apply an outward pressure on opposing internal sides of the refuse container.

Figure 8:
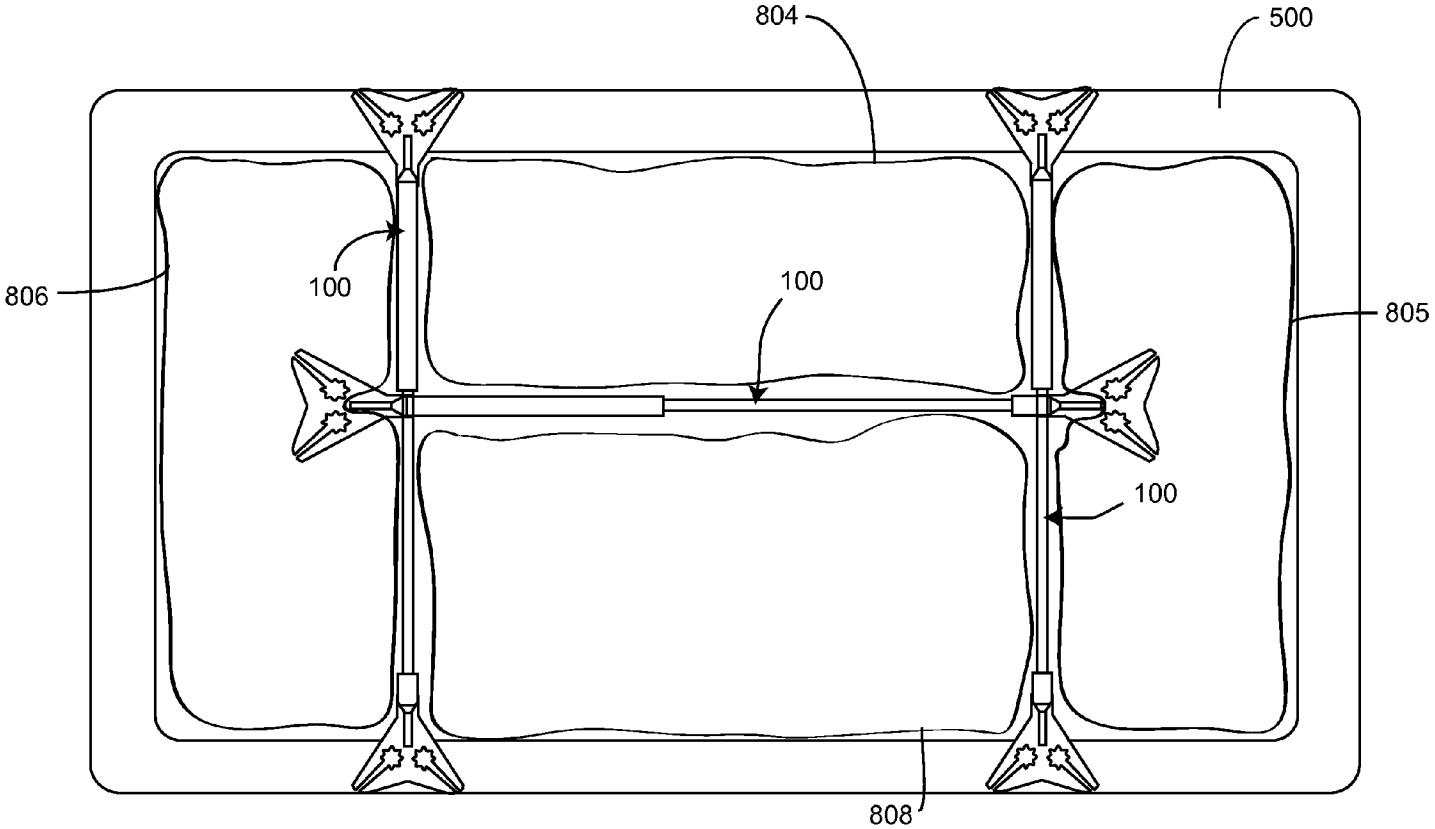
FIG. 8 is a top view of the system of the present invention, including three (3) refuse receptacle divider systems to divide a single compartment container into four (4) containment zones.

Now referring to FIG. 8, there is shown a refuse container with two refuse receptacle utility maximization systems 100 coupled thereto, together with another refuse receptacle divider system 100 disposed between and coupled to the other two refuse receptacle divider systems 100, so as together to support four (4) bags 804, 805, 806 and 808 creating four (4) separate and distinct garbage bag lined containment zones within the single refuse container.

Figure 9:
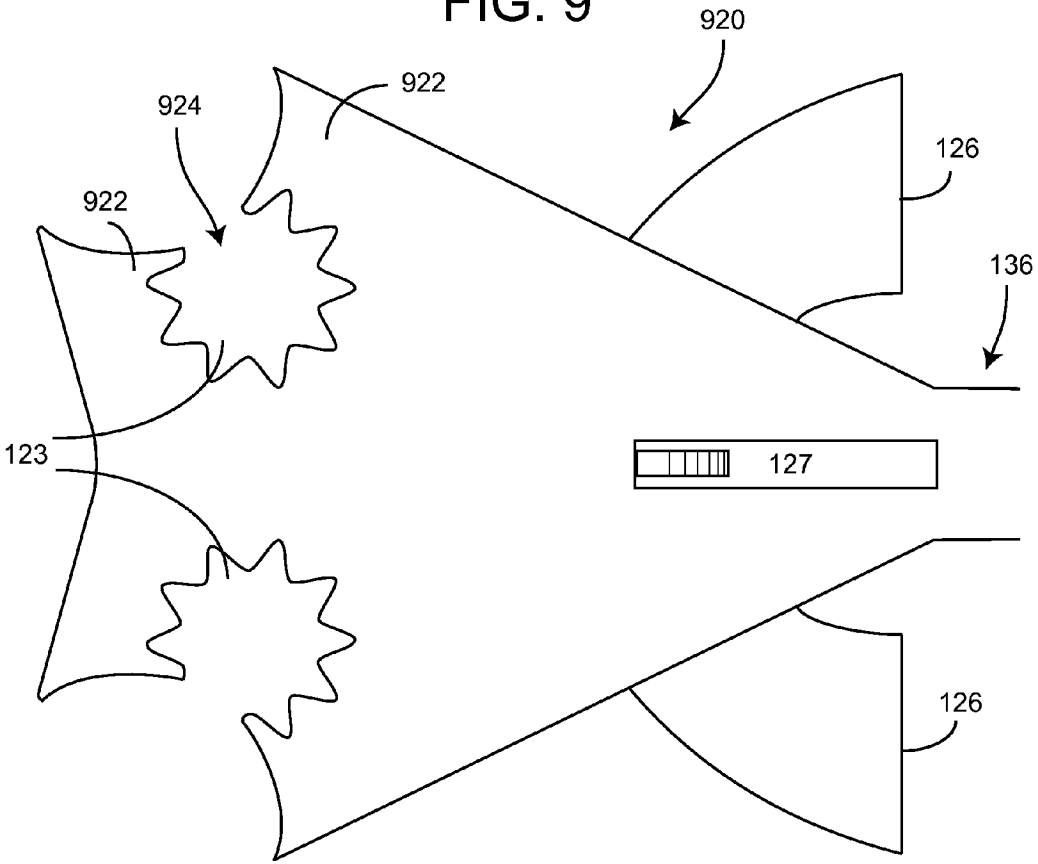
FIG. 9 is a close up view of an alternate embodiment of the present invention.

Now referring to FIG. 9, there is shown an alternate embodiment of the present invention which includes an end 920 with an alternate second gripping end bag receiving insertion gap defining member 922 with easy bag insertion void 924.

In operation, the system of FIG. 8 could function as follows:

A container with a single compartment is provided; a first refuse receptacle divider system 100 is added between opposing sides of the container. A second refuse receptacle divider system 100 is added between the same opposing sides of the container. A third refuse receptacle divider system 100 is positioned between the earlier two installed refuse receptacle divider systems 100. The adjustable length refuse container spanning beam 130 of each system is adjusted to provide a solid structure. Garbage bags are added to each of the containment zones as follows. The garbage bag is inserted into the container in a containment zone. The bag is attached to the top edge of the container as is normally done with garbage bags. The bag is gathered in the hand near one first gripping end 110 and wrapped around first gripping end bag engaging and refuse container lip emulating upwardly protruding finger 117, and then pulled through first gripping end bag receiving insertion gap 114 and gathered in first gripping end bag gathering void 113. At the other end of the refuse receptacle divider system 100, the bag is gathered and wrapped around second gripping end bag engaging and refuse container lip emulating upwardly protruding finger 127 pulled through second gripping end bag receiving insertion gap 124 and gathered at second gripping end bag gathering void 123. In FIG. 8, the two bags in the two central containment zones are able to be supported by four (4) corners by coupling with the two (2) ends of the non-container touching refuse receptacle divider system 100 and with one end from each of the other refuse receptacle divider systems 100. The volume of these containment zones is self adjusting in the sense that the volume of each of the four (4) containment zones could be nearly the volume of the entire container. The apportionment of the volume between the four (4) containment zones may be a function of how much is put in each bag and when. So if one bag is stuffed full, the contents of the bag will be located under the openings to the other containment zones. This provides much more flexibility than doe multiple cans or a single can with multiple fixed compartments. One additional feature of the present invention is the ability to adjust the amount of the bag that is available for containing refuse. When sorting recyclables is very important, often the best way to assure that unfamiliar users of the present system will use the correct containment zone for their particular recyclable waste, may be to provide at first a smaller volume of bags available to receive refuse. This will keep the refuse nearer the top of the container where the contents can be seen easier and thereby increasing the chances that like matter will be placed together in the proper containment zone. Then as the waste collection period progresses, the bags can be adjusted to allow for more volume as needed. The adjustment is very simple. The bags are detached from the first gripping end 110 and second gripping end 120 and more of the bags are moved into the container. The gathered portions of the bags will now be smaller and will be engaged with the first gripping end bag engaging and refuse container lip emulating upwardly protruding finger 117, first gripping end bag receiving insertion gap 114, and first gripping end bag gathering void 113 as done originally.

It is thought that the method and apparatus of the present invention will be understood from the foregoing description, and it will be apparent that various changes may be made in the form, construction, steps and arrangement of the parts and steps thereof without departing from the spirit and scope of the invention or sacrificing all of the material advantages, the form herein described being merely a preferred or exemplary embodiment thereof.

I claim:

1. A method of dividing a refuse container into a plurality of garbage bag lined refuse containment zones, which have easily adjustable volume characteristics; the method comprising the steps of:

providing a container with a top edge and an outside edge;

providing a first refuse receptacle divider system, comprising:

a container spanning beam with a bottom edge;

a first gripping end coupled to said container spanning beam;

said first gripping end further comprising:

a first gripping end bag engaging and container lip emulating upwardly protruding finger; and a first gripping end bag receiving insertion gap;

a second gripping end coupled to said container spanning beam;

said second gripping end further comprising:

a second gripping end bag engaging and container lip emulating upwardly protruding finger; and a second gripping end bag receiving insertion gap;

disposing said bottom edge of said container spanning beam, above said top edge and across a top opening of the container and disposing said first gripping end bag receiving insertion gap and said second gripping end bag receiving insertion gap above said top edge;

disposing a first bag on a first side of the container spanning beam and partially within said container;

placing a portion of said first bag over a first support;

gathering a first portion of said first bag and contacting said first gripping end bag engaging and refuse container lip emulating upwardly protruding finger;

increasing contact between said first portion and said first gripping end;

wherein said step of increasing contact between said first portion is accomplished by moving said first portion into said first gripping end bag receiving insertion gap;

disposing a second bag on a second side of the container spanning beam and partially within said container;

placing a portion of said second bag over a second support;

gathering a second portion of said second bag and contacting said second gripping end bag engaging and refuse container lip emulating upwardly protruding finger; and increasing contact between said second portion and said second gripping end wherein said step of increasing contact between said second portion is accomplished by moving said second portion into said second gripping end bag receiving insertion gap.

2. The method of claim 1 wherein said first bag is a first garbage bag and where said second bag is a second garbage bag and said first gripping end bag engaging and container lip emulating upwardly protruding finger and said second gripping end bag engaging and container lid emulating upwardly protruding finger are disposed outwardly of said outside edge and said first gripping end further comprising a first gripping end refuse container engaging foot prong extending below said top edge.

3. The method of claim 2 further comprising means for varying a separation between said first gripping end and said second gripping end.

4. The method of claim 3 wherein said means for varying a separation comprises means for adjusting a length of said container spanning beam.

5. The method of claim 2 wherein said first refuse container divider system is held in place with respect to said container by applying inwardly directed forces on opposing exterior sides of said container.

6. The method of claim 2 wherein said first refuse container divider system is held in place with respect to said container by applying outwardly directed forces on opposing interior sides of said container.

7. The method of claim 2 wherein said second support comprises:

a second refuse receptacle divider system, comprising:

a beam;

a first end coupled to said beam;

said first end further comprising:

a first end bag engaging and container lip emulating upwardly protruding finger;

a second end coupled to said container spanning beam;

said second end further comprising:

a second end bag engaging and container lip emulating upwardly protruding finger; and further comprising the steps of:

disposing a third garbage bag on a first side of the beam and partially within said container;

placing a portion of said third garbage bag over a third support;

gathering a portion of said third garbage bag and contacting said first end bag engaging and refuse container lip emulating upwardly protruding finger;

increasing contact between said portion of said third garbage bag and said first end.

8. The method of claim 7 wherein said first support and said third support are top edges of said container.

9. The method of claim 2 wherein said second support is a second refuse container divider system, coupled to said container spanning beam and disposed orthogonal to a longitudinal axis of said container spanning beam.

10. A method of providing an increased ability to see the contents of a plurality of garbage bag lined refuse containment zones located within a single container during a refuse collection time period by adjusting volume characteristics thereof; comprising the steps of:

providing a container with a single compartment with a top edge and an outside edge;

providing a divider system, comprising:

a container spanning beam with a bottom edge;

a first end coupled to said container spanning beam;

said first end further comprising:

a first end bag engaging and container lip emulating upwardly protruding finger; and a first end bag receiving insertion gap;

a second end coupled to said container spanning beam;

said second end further comprising:

a second end bag engaging and container lip emulating upwardly protruding finger; and a second end bag receiving insertion gap;

disposing said bottom edge of said container spanning beam above said top edge and across a top opening of the container and disposing said first end bag receiving insertion gap and said second end bag receiving insertion gap above said top edge;

disposing a first garbage bag on a first side of the container spanning beam and partially within said container;

placing a portion of said first garbage bag over a first support;

gathering a first portion of said first garbage bag and contacting said first end bag engaging and refuse container lip emulating upwardly protruding finger;

increasing contact between said first portion and said first end by inserting said first portion into said first end bag receiving insertion gap;

disposing a second garbage bag on a second side of the container spanning beam and partially within said container;

placing a portion of said second garbage bag over a second support;

gathering a second portion of said second garbage bag and contacting said second end bag engaging and refuse container lip emulating upwardly protruding finger; and increasing contact between said second portion and said second end by inserting said second portion into said second end bag receiving insertion gap; and adjusting a volume characteristic of said first garbage bag comprising the steps of:

decreasing contact between said first portion and said first end;

increasing the amount of the first garbage bag that is located inside of said container and which is free of any contact with any portion of said divider system;

gathering a third portion of said first garbage bag and contacting said first gripping end bag engaging and refuse container lip emulating upwardly protruding finger; and increasing contact of said third portion with said first end.

* * * * *